United States Patent [19]

Vokins

[11] Patent Number: 5,020,303

[45] Date of Patent: Jun. 4, 1991

[54] MACHINE FOR FILLING CONTAINERS WITH A FOOD PRODUCT

[75] Inventor: Ian M. Vokins, Oxfordshire, England

[73] Assignee: CMB Foodcan plc, Worcester, England

[21] Appl. No.: 441,946

[22] Filed: Nov. 27, 1989

[30] Foreign Application Priority Data

Aug. 3, 1989 [GB] United Kingdom ..... 8917810

[51] Int. Cl.[5] ..... B65B 31/02

[52] U.S. Cl. ..... 53/432; 53/510; 53/167; 53/282

[58] Field of Search ..... 53/432, 433, 510, 511, 53/167, 282

[56] References Cited

U.S. PATENT DOCUMENTS

| | | | |
|---|---|---|---|
| 2,240,655 | 5/1941 | Kronquest | 53/510 |
| 2,869,301 | 1/1959 | Stover . | |
| 2,950,587 | 8/1960 | Harmon et al. . | |
| 3,220,153 | 11/1965 | Cormack | 53/432 |
| 3,557,517 | 1/1971 | Limmer | 53/433 |
| 3,942,301 | 3/1976 | Domke | 53/510 X |
| 4,009,552 | 3/1977 | Schlachter | 53/510 X |
| 4,472,924 | 9/1984 | Vogele et al. | 53/511 |
| 4,624,099 | 11/1986 | Harder | 53/510 |

FOREIGN PATENT DOCUMENTS

| | | | |
|---|---|---|---|
| 0071759 | 2/1983 | European Pat. Off. . | |
| 0095812 | 12/1983 | European Pat. Off. | 53/432 |
| 0096336 | 12/1983 | European Pat. Off. . | |
| 0243003 | 10/1987 | European Pat. Off. . | |
| 0243073 | 10/1987 | European Pat. Off. . | |
| 0287789 | 10/1988 | European Pat. Off. . | |
| 3323710 | 1/1985 | Fed. Rep. of Germany . | |
| 1522654 | 8/1978 | United Kingdom . | |

*Primary Examiner*—John Sipos

*Attorney, Agent, or Firm*—Burns, Doane, Swecker & Mathis

[57] ABSTRACT

A machine for filling cups 42 with a food product has a conveyor formed from slats 40. The machine includes a loading station 10, a sterilizing station 12, a drying station 14, a filling station 16, a gassing station 18, a sealing station 20 and an unloading station. At the sealing station 20, closures cut from foil 84 are heat sealed onto the cups 42. The foil 84 is guided to the sealing station 20 by a series of rollers including a final roller 88 positioned above the conveyor. The function of the gassing station 18 is to create an atmosphere of nitrogen in the unfilled parts of the containers. The gassing station 18 has a gassing chamber formed partly by a casing member 70 and partly by the foil 84 as it passes downwardly to the final roller 88. The upper surface of the gassing chamber is above the rotational axis of the final roller 88. Nitrogen is injected into the gassing chamber by an injection tube 82 formed from sintered stainless steel, the pores in the steel acting as injection holes. By injecting the nitrogen in this manner, it enters the gassing chamber in a state of laminar flow. The shape of the gassing chamber and the fact that the nitrogen enters it in a state of laminar flow ensures that there is very little tendency for air to be drawn into the gassing chamber from the surrounding parts of the machine.

16 Claims, 5 Drawing Sheets

MACHINE FOR FILLING CONTAINERS WITH A FOOD PRODUCT

This invention relates to a machine for filling containers with a food product and also to a method of filling containers with a food product.

A known machine for filling containers with a food product comprises a conveyor which carries the containers along a horizontal path, a loading station for loading containers onto the conveyor, a filling station for filling the containers with a food product, a gassing station for creating an atmosphere of a desired gas in the unfilled parts of the containers, a sealing station for applying closures to the containers, and an unloading station for unloading the containers from the conveyor. Such a filling machine may include a sterilising station and a drying station located between the loading station and the filling station.

One reason for creating an atmosphere of a desired gas in the unfilled parts of the containers is to achieve a low level of oxygen in the sealed containers. Food products having a relatively high acidity, for example fruit juice or tomato juice, are prone to deteriorate during storage due to microbiological action if the oxygen content is not reduced to a low level. The gas which is normally used for reducing the oxygen content is nitrogen.

In a known filling machine, the gassing station comprises a chamber located above the conveyor and the desired gas is introduced through a slot in the wall of this chamber. When the gas is introduced in this manner, it enters the chamber in a state of turbulent flow, thereby causing air to be drawn into the chamber from surrounding parts of the machine. With this known arrangement, when the desired gas is nitrogen it is not possible to reduce the oxygen content to below about 6% by volume. In the case of a food product having a relatively high acidity, 6% is an unacceptably high level for the oxygen content.

It is an object of the invention to provide a new or improved machine for filling containers with a food product and it is another object of this invention to provide a new or improved method for filling containers with a food product.

According to one aspect of this invention, there is provided a machine for filling containers with a food product, said machine including a conveyor for carrying containers along a substantially horizontal path, a loading station for loading containers onto the conveyor, a filling station for filling the containers with a food product, a gassing station for creating an atmosphere of a desired gas in the unfilled parts of the containers prior to sealing, a sealing station for applying closures to the containers, and an unloading station for unloading containers from the conveyor, said stations being arranged along the horizontal path in the order recited, in which the gassing station comprises a chamber located above the conveyor between the filling and sealing stations and means for injecting the desired gas into the chamber through injection holes, said injection holes being sufficiently small to ensure that the gas enters the chamber in a state of laminar flow.

By ensuring that the desired gas enters the chamber of the gassing station in a state of laminar flow, the tendency for air to be drawn into the chamber from surrounding parts of the machine is substantially avoided. With the filling machine of this invention, where the desired gas is nitrogen, it is possible to reduce the oxygen content in the unfilled parts of the containers, after sealing, to below 2%.

According to another aspect of this invention, there is provided a method of filling containers with a food product comprising the steps of moving a conveyor along a substantially horizontal path, loading containers onto the conveyor at a loading station, filling the containers with a food product at a filling station, creating, prior to sealing, an atmosphere of a desired gas in the unfilled parts of the containers at a gassing station, applying closures to the containers at a sealing station, and unloading the containers from the conveyor at an unloading station, said stations being arranged along the horizontal path in the order recited, in which, in the step of creating an atmosphere of a desired gas in the unfilled parts of the containers, the desired gas is injected into a chamber located above the conveyor between the filling and sealing stations in a state of laminar flow.

This invention will now be described in more detail, by way of example, with reference to the drawings in which.

Figure 1:
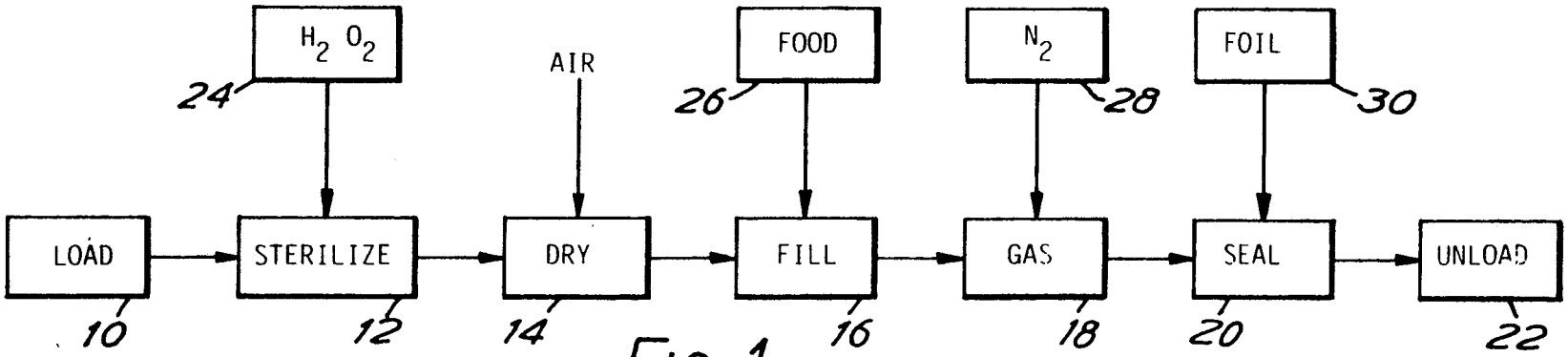
FIG. 1 is block diagram of a filling machine embodying this invention.

Referring now to FIG. 1, there is shown a block diagram of a filling machine embodying this invention. Although not shown in FIG. 1, the filling machine includes a conveyor and this conveyor passes, in turn, a loading station 10, a sterilising station 12, a drying station 14, a filling station 16, a gassing station 18, a sealing station 20, and an unloading station 22. At the loading station 10 containers are loaded onto the conveyor. At the sterilising station 12, a small quantity of hydrogen peroxide from a supply tank 24 is injected into each container. At the drying station 14, the containers are dried with heated air. At the filling station 16, the containers receive food from a supply vessel 26. At the gassing station 18, the containers pass through a chamber which receives nitrogen from a nitrogen cylinder 28. At the sealing station 20, the containers are sealed with closures which are cut out from foil received from a reel 30. In the present example, the sealing foil is formed from aluminium sheet but other materials are also suitable. At the unloading station 22, the containers are unloaded from the conveyor.

Some of the mechanical details of the filling machine will now be described with reference to FIG. 2.

The conveyor comprises a series of slats, some of which are indicated by reference numeral 40. Although not shown in FIG. 2, the slats 40 are pivotally connected together so as to form an endless loop and this endless loop passes around both guide and feed rollers.

The endless loop is moved in an indexing mode so as to ensure that the containers have an adequate dwell time at each station. In the present example, the containers take the form of conical cups, some of which are indicate by reference numeral 42. In order to carry these conical cups 42, each slat 40 has row of circular apertures. In the present example, the machine has four lanes and so each slat 40 has a row of four circular apertures.

At the loading station 10, the cups 42 are dispensed onto the conveyor from a row of four feed tubes, one of which is shown and indicated by reference numeral 44. At the sterilising station 12, hydrogen peroxide is injected into the cups 42 from a row of four nozzles, one of which is shown and indicated by reference numeral 46. The nozzles 46 receive hydrogen peroxide from a supply tube 48.

The drying station 14 has a casing 50 which defines both an upper chamber 52, which receives filtered air, and a drying chamber 54. A set of passages 56 lead from the upper chamber 52 to the drying chamber 54 and each of these passages 56 contains an electric heating coil 58 for heating the air. In the drying chamber 54, the heated air serves both to activate the sterilising action of the hydrogen peroxide and to dry the cups 42.

The filling station 16 and the gassing station 18 share a common solid casing member 70 which defines both a filling chamber 72 and a gassing chamber 74. The filling chamber 72 receives filtered air from a tube 76 formed from sintered stainless steel. The air is filtered by a filter which can be sterilized by steam. A row of four filling nozzles, one of which is shown and indicated by reference numeral 78, is mounted on the casing member 70 so as to inject the food product into the cups 42. The filling nozzles 78 receive the food product from a supply tube 80. The food product may be, for example, fruit juice or tomato juice. As will be described in more detail, nitogren is introduced into the gassing chamber 74 by an injection tube 82.

Sealing foil 84 is guided along a guide path by a set of rollers, two of which are shown and indicated, respectively, by reference numerals 86 and 88. The sealing foil 84 passes through a duct 90. The duct 90 receives heated air from a heater 92 which, in turn, receives filtered air from a duct 94. As the foil 94 passes through the duct 90, it is heated in preparation for the sealing operation at the sealing station 20.

Figure 2:
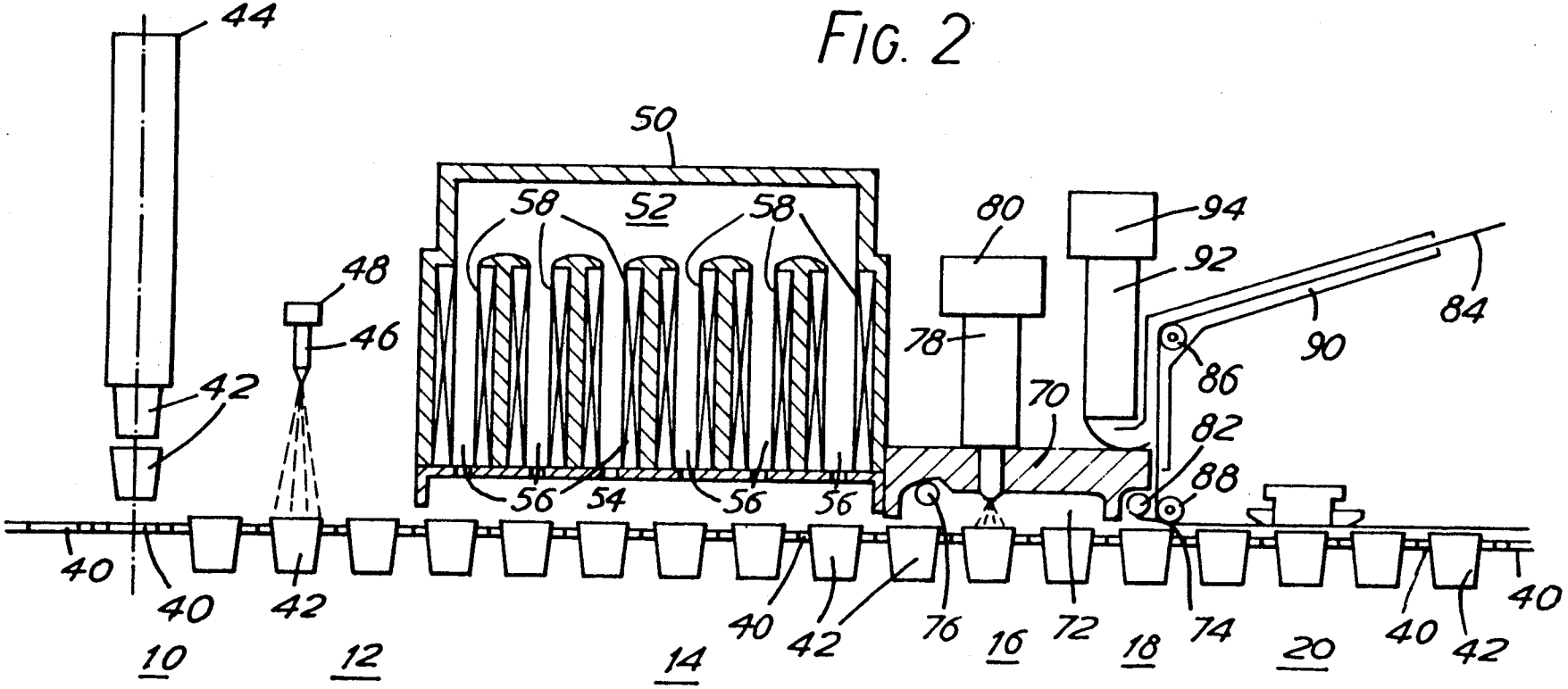
FIG. 2 is a greatly simplified elevational view, partly in cross-section, of the filling machine of FIG. 1.

With the exception of the details of the gas station 18 and the provision of the injection tube 76 formed from sintered steel in the filling station 16, the individual parts of the filling machine shown in FIGS. 1 and 2 are of a conventional design. An example of a filling machine having these conventional parts is the ML-4 Freshfill filling machine supplied by Genesis Packaging Systems, Foster Plaza VII, 661 Andersen Drive, Pittsburgh, Pa., USA.

The gassing station 16 and the sealing station 20 will now be described in greater detail with reference to FIG. 3.

The sealing station 20 has a row of four sealing heads, one of which is shown and indicated by reference numeral 100. The sealing head 100 has a mounting plate 102, a circular cutter 104, a sealing member 106, and a heating coil 108 for the sealing member 106. In operation, with one of the cups 42 stationary below the sealing head 100, the sealing member 106 is moved downwardly so as to heat seal the foil 84 onto the cup 42. The cutter 104 is then moved downwardly to cut a circular closure from the foil 84.

Immediately before the roller 88, the guide path for the foil 84 has a downward stretch 110 and, as the foil passes along this downward stretch, it forms a wall of the chamber 74 of the gassing station 18.

Figure 4:
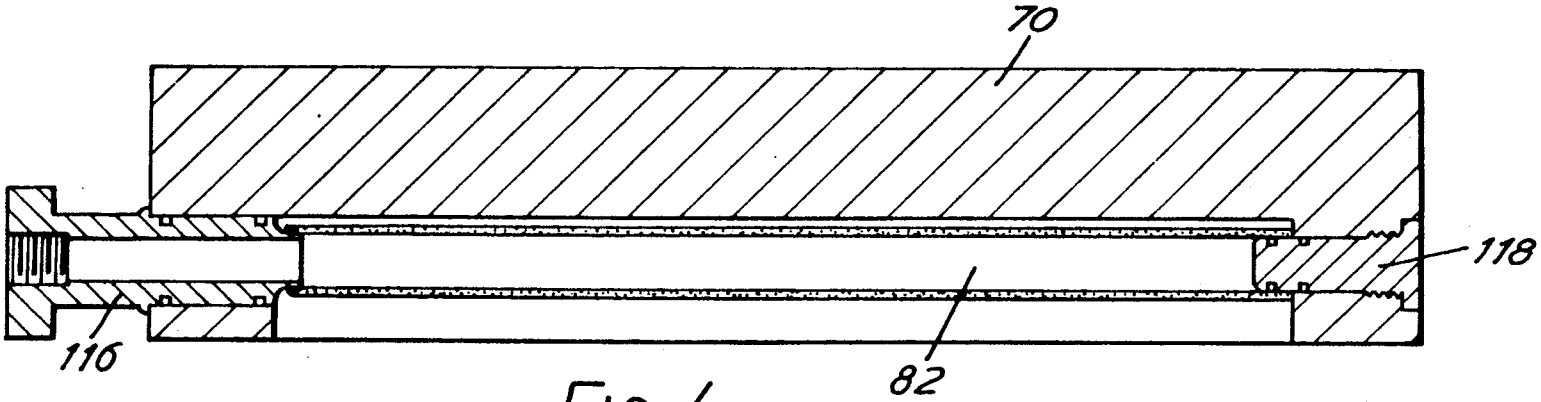
FIG. 4 is a cross-sectional view of an injection tube forming part of the gassing station.

As noted previously, the gassing station 18 comprises an injection tube 82 located in a gassing chamber 74. The upper surface 112 of the gassing chamber 74 is defined by the casing member 70. As may be seen, this upper surface 112 is above the level of the axis of rotation 114 of roller 88. The sintered stainless steel, from which the injection tube is formed, is of a porous structure and its pores form holes for injecting the nitrogen into the chamber 74. As shown in FIG. 4, the injection tube 82 is mounted between a connector member 116 and a plug 118, both of which are mounted on the casing member 70.

In operation, nitrogen is injected into chamber 74 by injection tube 82. Because the pores of tube 82 are small, the nitrogen enters the chamber 74 in a state of laminar flow. Because the gas enters chamber 74 in a state of laminar rather than turbulent flow, it does not entrain air from surrounding parts of the machine. Any tendency for the nitrogen to entrain air from surrounding parts of the filling machine is also avoided by positioning the upper surface of 112 of chamber 74 above the rotational axis 114 of roller 88. As the cups 42 pass through the filling station 18, an atmosphere of nitrogen is created in their unfilled parts to the almost complete exclusion of oxygen. With the arrangement shown in FIG. 3, it has been found that the oxygen content in the unfilled parts of the sealed containers is less than 2% by volume.

Although the injection tube 82 formed from sintered steel represents the preferred arrangement for injecting nitrogen into the gassing chamber 74, other arrangements are possible. For example, nitrogen could be injected by an injection tube formed from non-sintered stainless steel in which injection holes are formed. By way of another alternative, the nitrogen could be injected through injection holes formed in the casing member 70. With either of these arrangements, it is essential that the injection holes are small enough to ensure that the nitrogen gas enters the chamber 74 in the state of laminar flow.

Figure 5:
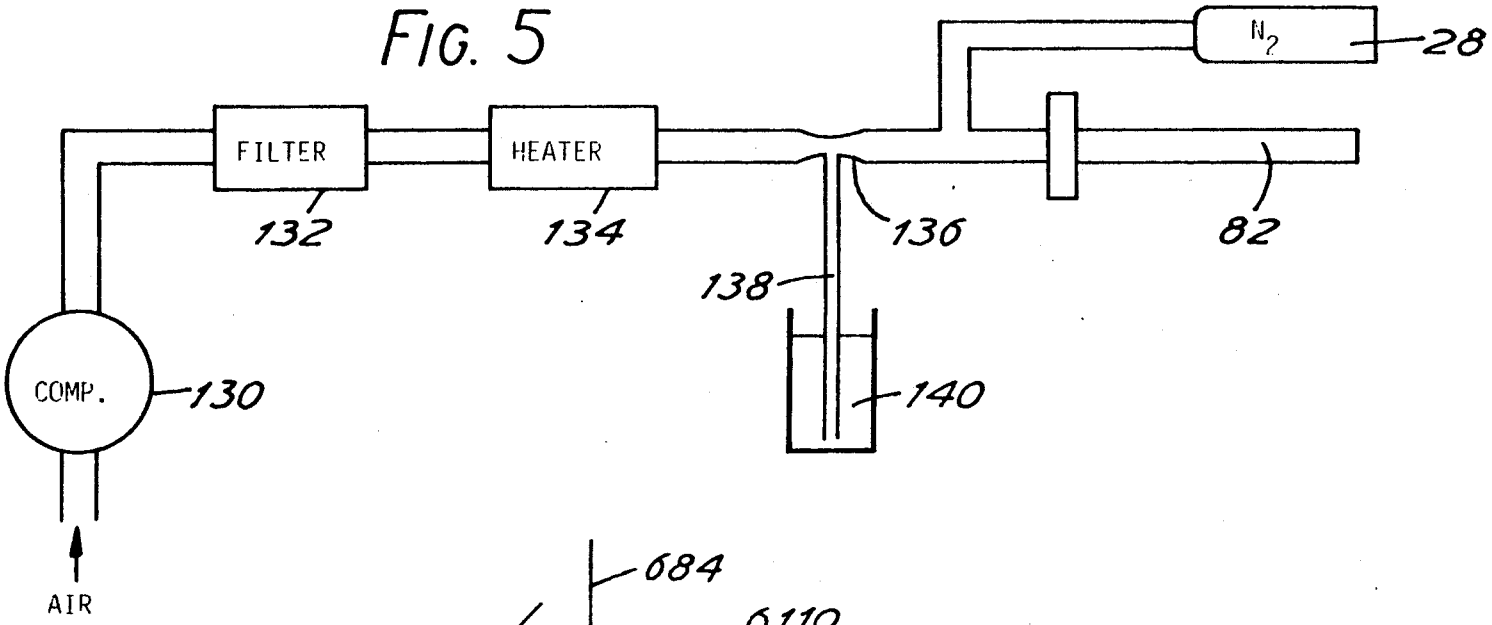
FIG. 5 is a circuit diagram of a sterilising arrangement for the gassing station.

Before a filling operation, the various parts of the filling machine described above have to be sterilised. With the exception of the gassing station, such sterilisation is performed in a conventional manner. In the case of the gassing station 18, a circuit diagram for the sterilising arrangement is shown in FIG. 5. This sterilisation arrangement comprises an air compressor 130, a filter 132, a heater 134 for heating the air to a temperature in the range of 110° C. to 120° C., and a venturi 136 leading to the injection tube 82. The throat of venturi 136 is connected by a tube 138 to a reservoir 40 containing hydrogen peroxide. In order to perform a sterilization operation, the supply of gas from the nitrogen cylinder 28 is shut off. The compressor 130 and the heater 134 are turned on with the result that a mixture of heated air and hydrogen peroxide are injected into the gassing chamber 74, thereby sterilising the walls of this chamber.

Figure 6:
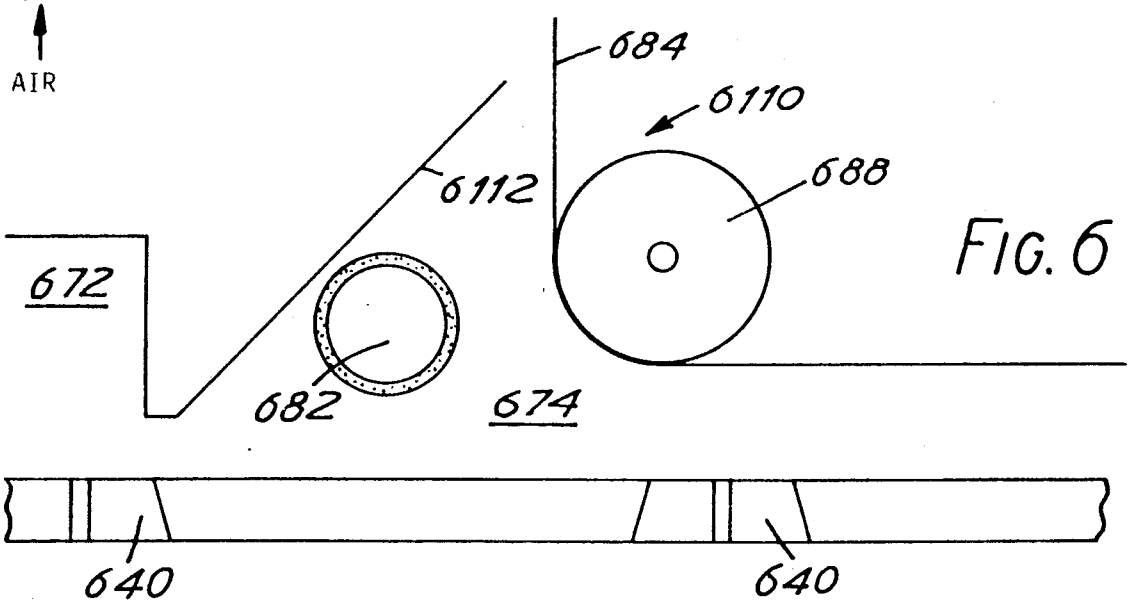
FIG. 6 is an elevational view of an alternative gassing station for the filling machine of FIG. 1.

Referring now to FIG. 6 there is shown an alternative arrangement for the gassing station of the filling machine shown in FIGS. 1 to 4. The arrangement shown in FIG. 6 is generally similar to that shown in FIG. 3 and like parts are denoted by the same reference numerals preceded by numeral "6". In the arrangement shown in FIG. 6, the upper surface 6112 of the gassing chamber 674 extends upwardly, with respect to the direction of movement of the conveyor. This upper surface 6112 approaches the downward stretch 6110 of the guide path for foil 684 at a position above the level of the rotational axis of roller 688.

Figure 7:
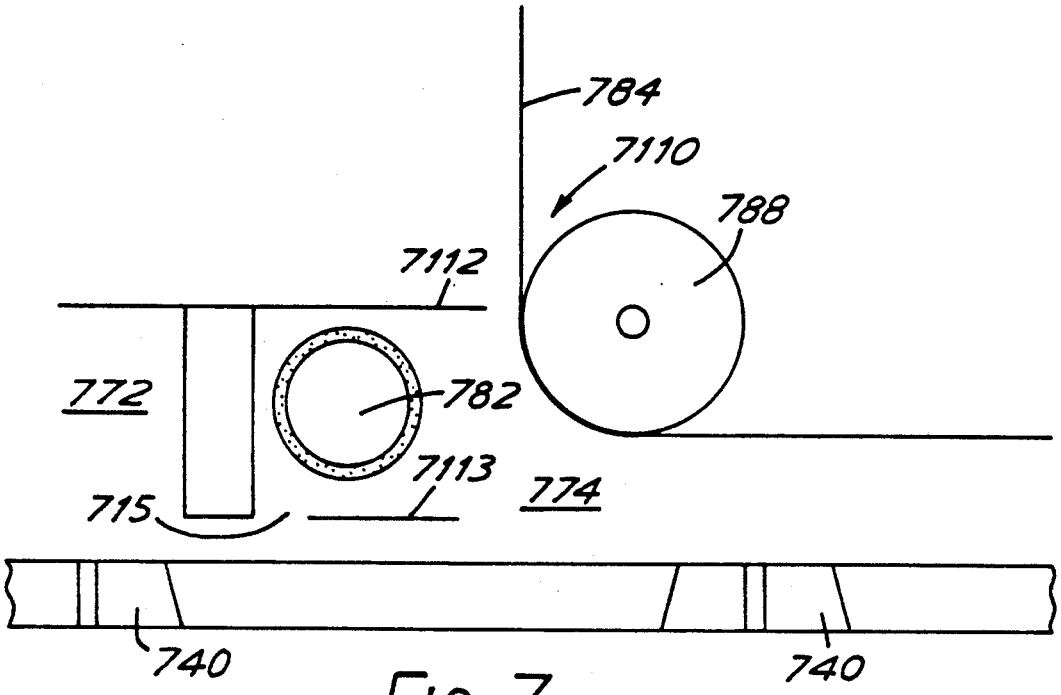
FIG. 7 is an elevational view of another alternative gassing station for the filling machine of FIG. 1.

Referring now to FIG. 7, there is shown a sketch of another arrangement for the gassing station for the filling machine of FIGS. 1 to 4. This further arrangement is also generally similar to the arrangement shown in FIG. 3 and like parts are denoted by the same reference numerals but preceded by numeral "7". In the arrangement shown in FIG. 7, the upper surface 7112 of the gassing chamber 774 extends horizontally at the level of the axis of rotation of the roller 788. The gassing chamber 774 has a lower wall 7113 which has an opening 7115 at its upstream end.

Figure 3:
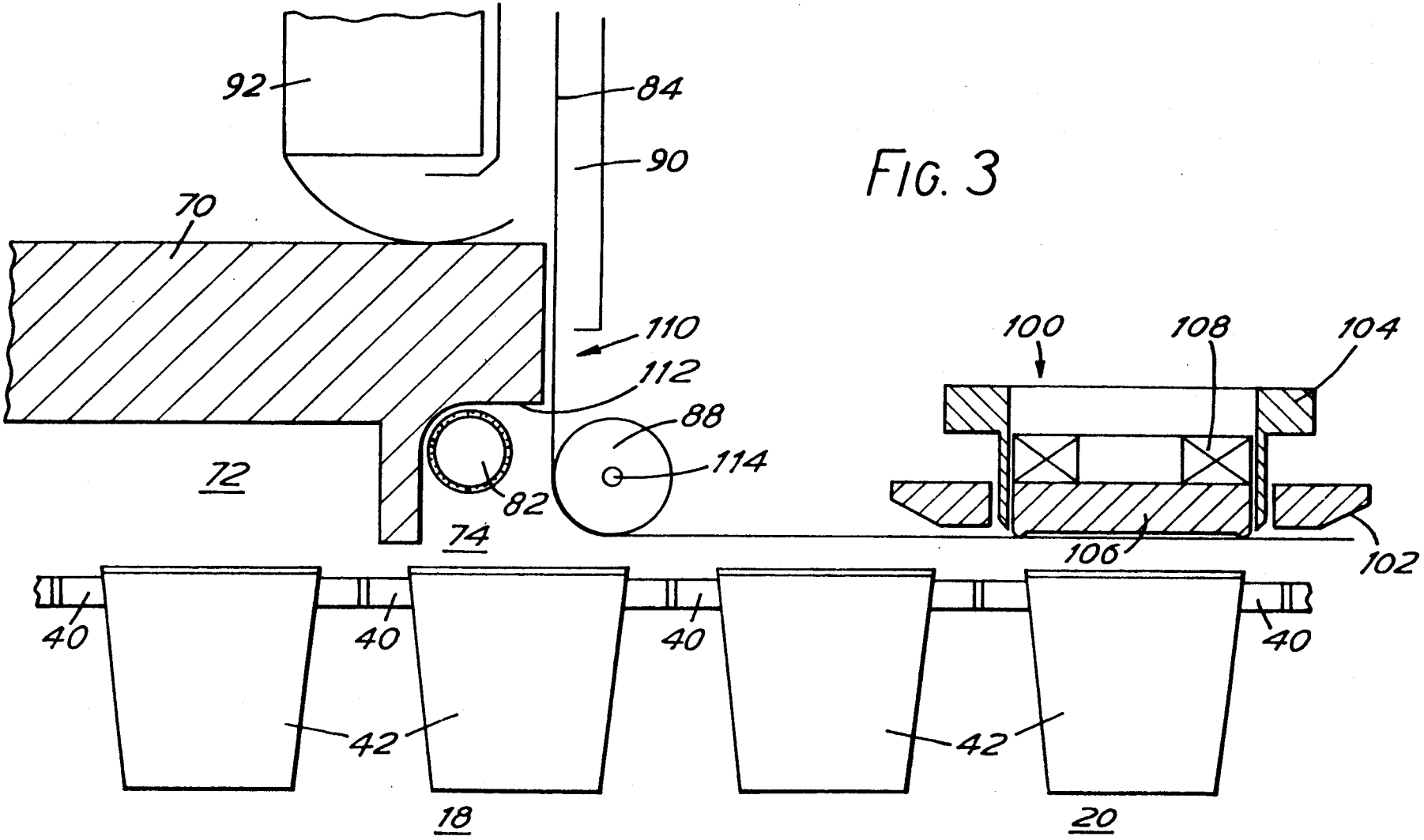
FIG. 3 is an elevational view, partly in cross-section, of the gassing station and sealing stations of the filling machine of FIG. 1.

In trial tests, it has been found that the level of the oxygen content in sealed containers is slightly higher in the arrangements shown in FIGS. 6 and 7 than in the arrangement shown in FIG. 3. However, levels below 2% can be achieved in the arrangement of FIG. 6 or the arrangement of FIG. 7 and so both of these arrangements are satisfactory.

Figure 8:
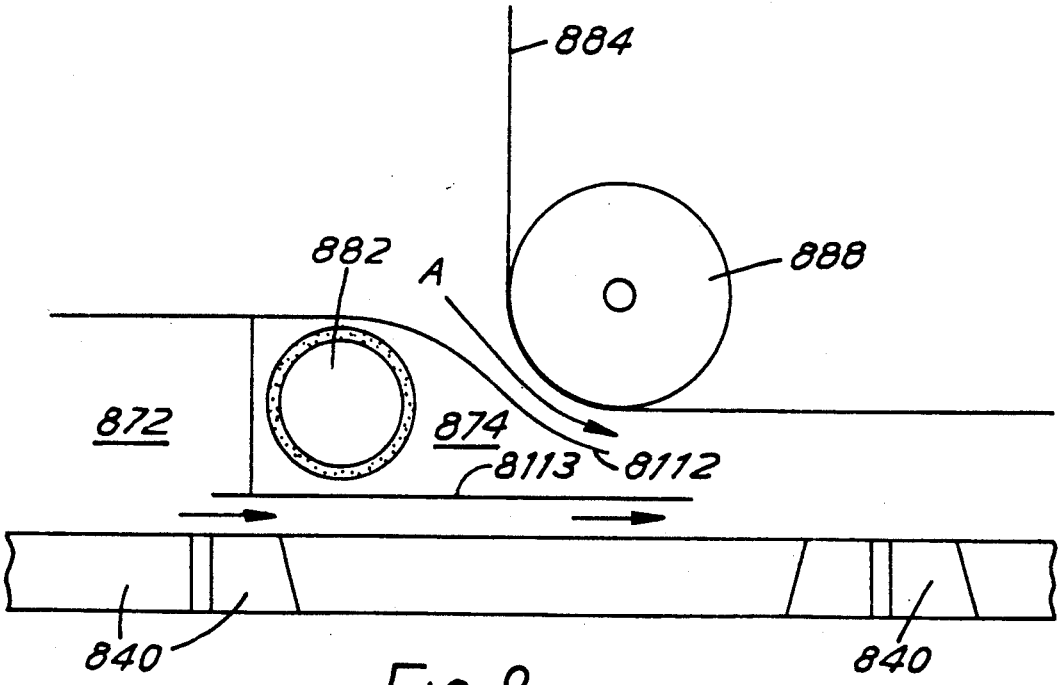
FIG. 8 is an elevational view of experimental gassing station which produced unsatisfactory results.

Referring now to FIG. 8, there is shown an arrangement for a gassing chamber which has proved to be unsatisfactory. In FIG. 8, parts which are similar to the parts shown in FIG. 3 are indicated by the same reference numerals but preceded by numeral "8". In the arrangement of FIG. 8, the upper surface 8112 of the gassing chamber 874 extends horizontally and then downwardly, in relation to the direction to the movement of the conveyor, and terminates immediately below the axis of rotation of roller 888. The gassing chamber 874 has a lower wall which extends continuously from the outlet of the filling chamber 872 and terminates below the axis of rotation of roller 888. With this arrangement the velocity of the nitrogen increases as it flows into the restriction formed between the upper surface 8112 and the lower wall 8113. The consequent drop in pressure causes air to be entrained from surrounding parts of the machine along the paths indicated by arrows A. Because of this entrainment of air, low levels for the oxygen content in the sealed containers cannot be achieved.

In the filling machine described above, nitrogen is supplied to the gassing chamber for the purpose of achieving a low level for the oxygen content in the sealed containers. In view of its natural abundancy, nitrogen represents the natural choice for this purpose, but, if desired, another gas may be used in its place. Also, although the arrangements shown in FIGS. 3,6 and 7 have been described with reference to creating an atmosphere of nitrogen so as to reduce the oxygen content, these arrangements are suitable for creating an atmosphere of a particular gas for a different purpose.

I claim:

1. A machine for filling containers with a food product, said machine including a conveyor for carrying containers along a substantially horizontal path;

a loading station for loading containers onto the conveyor;

a filling station for filling the containers with a food product;

a gassing station for creating an atmosphere of a desired gas in the unfilled parts of the containers prior to sealing;

a sealing station for applying closures to the containers; and an unloading station for unloading containers from the conveyor;

said stations being arranged along the horizontal path in the order recited;

said gassing station comprising a gassing chamber located above the conveyor between the filling and sealing stations and an injection tube formed from a sintered metal located in the gassing chamber for injecting the desired gas into the chamber in a state of laminar flow;

said machine further including a set of rollers for guiding sealing foil along a guide path to the sealing station, said rollers including one roller located above the conveyor and upstream, in the direction of movement of the conveyor, from the sealing station, said guide path including a downward stretch leading to said one roller and the sealing foil passing along said downward stretch forming a wall of the gassing chamber; and the gassing chamber having an upper surface which approaches said downward stretch of said guide path at a position which is above or at the level of the axis of said one roller.

2. A filling machine as claimed in claim 1, in which the injection tube is formed from sintered steel.

3. A filling machine is claimed in claim 1, in which the desired gas is nitrogen.

4. A filling machine as claimed in claim 1, including means for introducing a mixture of heated air and hydrogen peroxide through the injection tube in order to sterilise the chamber prior to the commencement of a filling operation.

5. A filling machine as claimed in claim 1, including a sterilising station and a drying station located between the loading station and the filling station.

6. A filling machine as claimed in claim 1, in which said upper surface of the gassing station extends horizontally.

7. A filling machine as claimed in claim 6, in which said upper surface of the gassing station approaches said downward stretch of the guide path at a position which is above the axis of said one roller.

8. A filling machine as claimed in claim 1, in which said upper surface of the gassing station is inclined upwardly in the direction of movement of the conveyor.

9. A filling machine as claimed in claim 1, in which there are a plurality of lanes of containers.

10. A method of filling containers with a food product comprising the steps of moving a conveyor along a substantially horizontal path, loading containers onto the conveyor at a loading station, filling the containers with a food product at a filling station, creating, prior to sealing, an atmosphere of a desired gas in the unfilled parts of the containers at a gassing station, applying closures to the containers at a sealing station, and unloading the containers from the conveyor at an unloading station, said stations being arranged along the horizontal path in the order recited, in which, in the step of creating an atmosphere of a desired gas in the unfilled parts of the containers, the desired gas in injected into a chamber located above the conveyor between the filling and sealing stations in a state of laminar flow by means of an injection tube formed from a sintered metal, the method further including the step of guiding sealing foil along a guide path to the sealing station with the aid of a set of rollers, said rollers including one roller located along the conveyor and upstream, in the direction of movement of the conveyor, from the sealing station, said guide path including a downward stretch leading to said one roller and the sealing foil passing along said downward stretch forming a wall of the chamber of the gassing station in which the upper surface of the wall of the gassing station approaches said downward stretch of the guide path at a position which is above or at the axis of rotation of said one roller.

11. A method of filling containers as claimed in claim 10, in which the desired gas in nitrogen.

12. A method of filling containers as claimed in claim 10, including the step of introducing a mixture of heated air and hydrogen peroxide into the chamber of the gassing station in order to sterilise the chamber prior to the commencement of a filling operation.

13. A method of filling containers as claimed in claim 10, in which the upper surface of the chamber of the gassing station extends horizontally.

14. A method of filling containers as claimed in claim 10, in which the upper surface of the chamber of the gassing station is inclined upwardly in the direction of movement of the conveyor.

15. A method of filling containers as claimed in claim 10, in which said upper surface of the gassing station approaches said downward stretch of the guide path at a position which is above the axis of said one roller.

16. A method of filling containers as claimed in claim 10, in which there are a plurality of lanes of containers.

* * * * *